US008776291B1

(12) United States Patent
Lewis

(10) Patent No.: US 8,776,291 B1
(45) Date of Patent: Jul. 15, 2014

(54) RESCUE DEVICE

(71) Applicant: Ryan Leighton Lewis, Lubbock, TX (US)

(72) Inventor: Ryan Leighton Lewis, Lubbock, TX (US)

( * ) Notice: Subject to any disclaimer, the term of this patent is extended or adjusted under 35 U.S.C. 154(b) by 0 days.

(21) Appl. No.: 14/017,626

(22) Filed: Sep. 4, 2013

(51) Int. Cl.
*A47B 1/00* (2006.01)
*A45F 4/06* (2006.01)
*A61G 1/044* (2006.01)
*A61G 1/048* (2006.01)

(52) U.S. Cl.
CPC ..... *A61G 1/044* (2013.01); *A61G 1/048* (2013.01)
USPC ..... 5/628; 5/625; 5/626; 224/156

(58) Field of Classification Search
USPC ..... 5/625–629; 224/575, 576, 153, 155, 224/156, 157
See application file for complete search history.

(56) References Cited

U.S. PATENT DOCUMENTS

| | | | | | |
|---|---|---|---|---|---|
| 2,316,456 | A * | 4/1943 | Robes, Jr. | 224/156 |
| 2,394,300 | A * | 2/1946 | Goerg | 224/156 |
| 2,924,831 | A * | 2/1960 | Hankins | 5/626 |
| 3,151,343 | A * | 10/1964 | McCormick | 5/627 |
| 3,184,128 | A * | 5/1965 | Siegfried | 224/153 |
| 3,225,985 | A * | 12/1965 | Romney | 224/153 |
| 3,449,776 | A * | 6/1969 | Brock | 5/627 |
| 3,464,607 | A * | 9/1969 | Grace et al. | 224/156 |
| 3,566,422 | A * | 3/1971 | Klippel | 5/627 |
| 3,693,849 | A * | 9/1972 | Knabenbauer | 224/153 |
| 3,846,855 | A * | 11/1974 | Peterson | 5/114 |
| 4,056,857 | A * | 11/1977 | Quantz | 5/112 |
| 4,392,598 | A * | 7/1983 | Dixon | 224/155 |
| 4,883,206 | A * | 11/1989 | Miller | 224/153 |
| 4,885,812 | A * | 12/1989 | Lindner | 5/113 |
| 5,274,864 | A * | 1/1994 | Morgan | 5/627 |
| 5,588,445 | A * | 12/1996 | Obaidi | 128/846 |
| 6,216,296 | B1 * | 4/2001 | Carrasco | 5/625 |
| 7,082,632 | B2 * | 8/2006 | Hood | 5/625 |
| 7,607,184 | B1 * | 10/2009 | Goodner, Jr. | 5/627 |
| 7,774,878 | B1 * | 8/2010 | Florea et al. | 5/627 |
| 8,434,653 | B2 * | 5/2013 | Clark et al. | 224/154 |
| 2008/0155751 | A1 * | 7/2008 | Thompson et al. | 5/626 |
| 2009/0313759 | A1 * | 12/2009 | Wong | 5/627 |
| 2010/0005593 | A1 * | 1/2010 | Bowling et al. | 5/627 |
| 2010/0237111 | A1 * | 9/2010 | Mroczka | 224/156 |
| 2011/0220695 | A1 * | 9/2011 | Saunders et al. | 224/158 |

* cited by examiner

*Primary Examiner* — William Kelleher
*Assistant Examiner* — Eric Kurilla
(74) *Attorney, Agent, or Firm* — Plager Schack LLP

(57) ABSTRACT

A rescue device is configured to permit rapid evacuation of a casualty by easily attaching to a casualty. The rescue device includes a shell comprising a cavity and mechanically coupled to shoulder straps which can secure the shell to the casualty. An attachment strap is mechanically coupled to the shell which can secure the shell to the casualty holding the shell in place. A lower carrying surface can be deployed from the shell that can support the casualty. There are handles mechanically coupled to the shell and handle bars mechanically coupled to the lower carrying surface in order to permit easily carrying the casualty to safety.

5 Claims, 2 Drawing Sheets

RESCUE DEVICE

BACKGROUND

The embodiments herein relate generally to tactical gear and equipment.

Prior to embodiments of the disclosed invention, single person rescue of casualties was physically demanding, time consuming, and dangerous. Casualties were dragged on the ground by one rescuer or they were carried by existing clothes, extremities, or equipment. If stretchers were used, they must be carried by rescuers and must be taken to the point of wounding and then the injured person is placed on the stretcher. Further, limited numbers of stretchers are available due to size and weight issues and only a select few may be carried.

Prior art systems rely upon medics to carry equipment to the injured soldier. Likewise, other systems only consist of drag straps and sometimes handles and do not have friction-reducing devices which decrease the difficulty in rescuing the injured soldier. Existing handles are often poorly placed and are not realistic to use in a true rescue. Embodiments of the disclosed invention solve this problem.

SUMMARY

A rescue device is configured to permit rapid evacuation of a casualty by easily attaching to a casualty. The rescue device includes a shell comprising a cavity and mechanically coupled to shoulder straps which can secure the shell to the casualty. An attachment strap is mechanically coupled to the shell which can secure the shell to the casualty holding the shell in place. A lower carrying surface can be deployed from the shell that can support the casualty. There are handles mechanically coupled to the shell and handle bars mechanically coupled to the lower carrying surface in order to permit easily carrying the casualty to safety.

In some embodiments, the shell is further mechanically coupled to a drag strap which is further mechanically coupled to an attachment point wherein a user can attach the attachment point to a dragger to drag the casualty. The shell is further mechanically coupled to a drag strap pouch which is mechanically coupled to drag strap pouch cover such that the drag strap and the attachment point can be stored in the drag strap pouch and covered with the drag strap pouch cover.

In some embodiments, the lower carrying surface is mechanically coupled to a pull tab which is used to deploy the lower carrying surface. The shoulder straps are fastened around the casualty using a latch.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
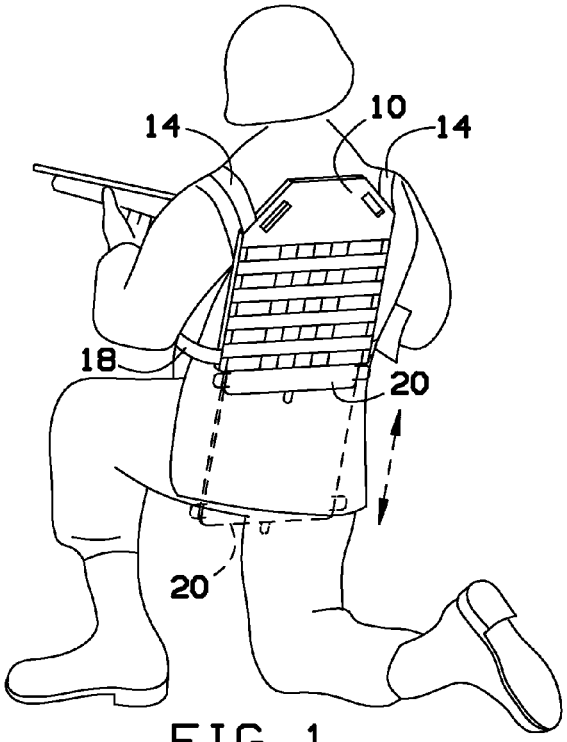
FIG. 1 is a perspective view of an embodiment of the invention in use.
Figure 2:
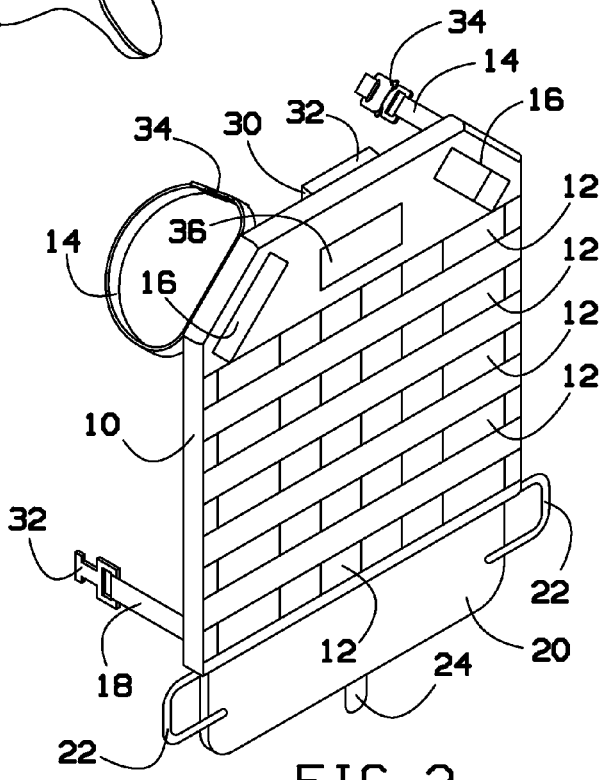
FIG. 2 is a perspective view of an embodiment of the invention illustrating the lower carrying surface in the stowed position.

By way of example, and referring to FIG. 1 and FIG. 2, one embodiment of the rescue device comprises external shell 10 covered with strips of webbing 12. External shell 10 is mechanically coupled to shoulder straps 14 which can be wrapped around a casualty's shoulders and fastened using latch 34. Shell 10 can be further attached to a user with attachment strap 18 which can be fastened to a casualty or a casualty's body armor using fastener 38.

Shell 10 is further mechanically coupled to drag strap pouch 30 which is mechanically coupled to drag strap pouch cover 32. Drag strap pouch 30 is mechanically coupled to drag strap 26 mechanically coupled to attachment point 28 that can be used to drag the user by a dragger.

Figure 3:
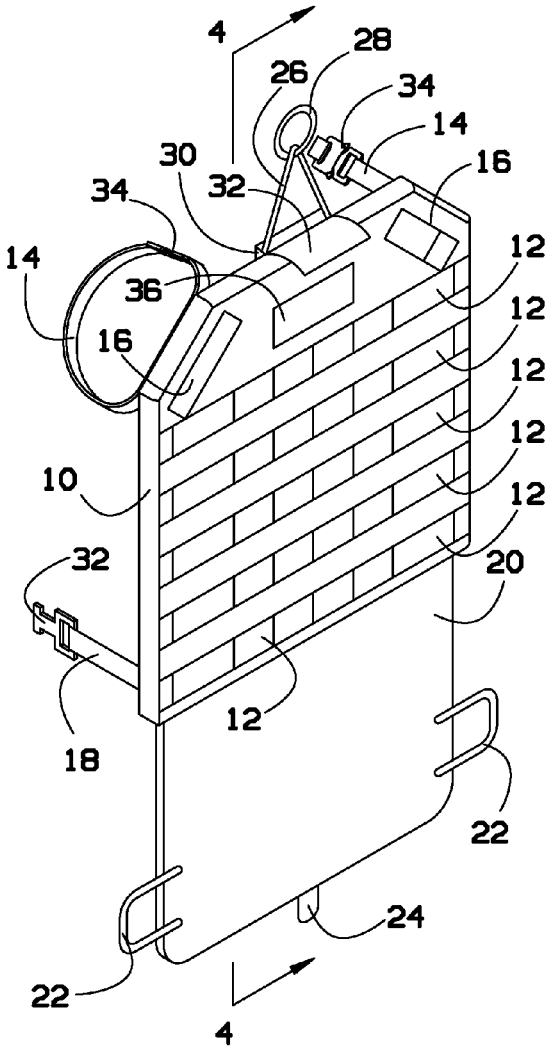
FIG. 3 is a perspective view of an embodiment of the invention is a perspective view of the invention illustrating the lower carrying surface in the deployed position.
Figure 4:
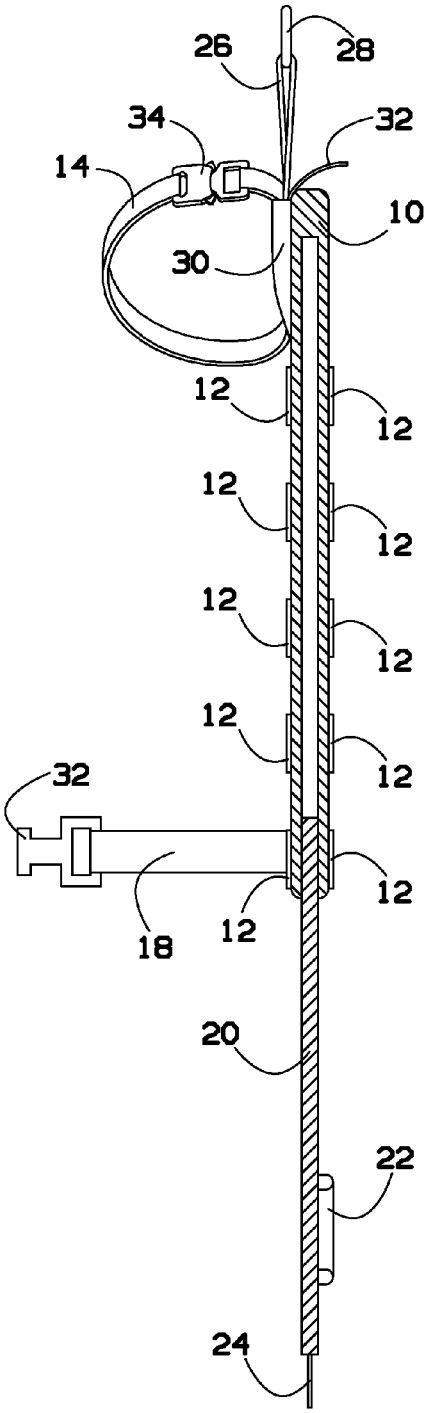
FIG. 4 is a section view of an embodiment of the invention taken about line 4-4 in FIG. 3.

FIG. 3 and FIG. 4 show another advantage over the prior art, the ability to be used as a field litter. Shell 10 is hollow and possesses a cavity that can accommodate lower carrying surface 20. Lower carrying surface 20 is further mechanically coupled to handle bars 22 and pull tab 24. A user can deploy lower carrying surface 20 by simply pulling on handle 24.

Shell 10 can be made from a hard material such as most plastics woods or metals that are fabricated using known method and covered in a fabric such as those sold under the CORDURA® trademark. The fabric can be sewn to strips of Modular Lightweight Load-carrying Equipment (MOLLE) webbing. Attachment strap 18 can be made of nylon and latch 34 can be a COBRA® style buckle. Shoulder strap 14 can be made from nylon webbing and is sewn to the material using bar tack style techniques and has a COBRA® style buckle to attach with ease. Lower surface area 20 is attached to a cavity in shell 10 using grommets on the top of the hard plastic with nylon webbing attached thru the grommets and sewn to the top of the internal portion of shell 10 using bar tack style sewing techniques. Handle bars 22 can be made from nylon webbing attached mechanically coupled to lower surface area 20 using grommets and sewing the webbing in a circle thru the grommets so the webbing is used as a handle on lower surface area 20. Pull tab 24 can be a single piece of nylon webbing attached to lower surface area 20 with a grommet and secured by looping Pull tab 24 thru and sewing it back onto itself. Drag strap 26 can be two pieces of nylon webbing sewn within drag strap pouch 30 using bar tack style techniques. The nylon webbing come together at attachment point 28 which can be a circular aluminum ring that serves as an attachment point for a handle or d-ring which can be used to drag the casualty as described below.

As shown in FIG. 1, some embodiments of the rescue device are mounted to existing body armor systems. Each rescue device provides an immediate stretcher/rescue litter on the back of each soldier on the battlefield without medics having to carry stretchers or rescue devices to the casualty. This decreases equipment carried onto the battlefield as separate devices because the rescue device is already mounted onto or within body armor worn by the soldiers. It also assures that enough rescue devices are deployed because every soldier already has a rescue device on one's back permitting rapid evacuation of the casualty.

The rescue devices themselves are improved because the time required to effect the rescue is greatly reduced because rescue equipment is already in place and can be rapidly deployed by simply pulling on tab 24 and then carrying the casualty with handle bars 22, handles 16 or attachment ring 28 as needed, thus minimizing further risk to rescuers and the casualty. The physical aspect of the rescue is also improved because the shell 10 serves as a barrier between the casualty and the ground when dragging the casualty—this decreases friction and makes dragging the casualty easier.

The above construction is exemplary but not exclusive, other embodiments of the rescue device could be built into existing body armor systems, bunker gear for firefighters, urban search and rescue devices, and any rescue related industry. The rescue device could be added to backpacks, vests, or jackets of rescue personnel, firefighters, adventure athletes, hikers, backpackers, or extreme racers.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A rescue device configured to permit rapid evacuation of a casualty by attaching to a casualty, the rescue device comprising, a shell comprising a cavity and mechanically coupled to shoulder straps which can secure the shell to the casualty;

an attachment strap mechanically coupled to the shell which can secure the shell to the casualty holding the shell in place; and a lower carrying surface which can be deployed from the shell that can support the casualty; and webbing, attached to a front and back side of the shell such that a front side webbing increases friction between the rescue device and the casualty and a back side webbing prevents the rescue device from sliding;

wherein handles are integrated to the shell and handle bars mechanically coupled to the lower carrying surface permits easily carrying the casualty to safety.

2. The rescue device of claim 1, wherein the shell is further mechanically coupled to a drag strap which is further mechanically coupled to an attachment point wherein a user can attach the attachment point to a dragger to drag the casualty.

3. The rescue device of claim 1, further comprising the shell is further mechanically coupled to a drag strap which is further mechanically coupled to an attachment point wherein a user can attach the attachment point to a dragger to drag the casualty; and the shell is further mechanically coupled to a drag strap pouch which is mechanically coupled to a drag strap pouch cover such that the drag strap and the attachment point can be stored in the drag strap pouch and covered with the drag strap pouch cover.

4. The rescue device of claim 1, wherein the lower carrying surface is mechanically coupled to a pull tab which is used to deploy the lower carrying surface.

5. The rescue device of claim 1, wherein the shoulder straps are fastened around the casualty using a latch.

* * * * *